US007469487B2

(12) United States Patent
Macher et al.

(10) Patent No.: US 7,469,487 B2
(45) Date of Patent: Dec. 30, 2008

(54) DEVICE FOR DRYING SHOES, GLOVES OR GARMENTS

(75) Inventors: David Macher, Voitsberg (AT); Heinz Zorn, Eggersdorf (AT); Gerhard Schreiner, Graz (AT)

(73) Assignee: Therm-IC Products GmbH, Gleisdorf (AT)

( * ) Notice: Subject to any disclaimer, the term of this patent is extended or adjusted under 35 U.S.C. 154(b) by 404 days.

(21) Appl. No.: 10/182,660

(22) PCT Filed: Jan. 30, 2001

(86) PCT No.: PCT/EP01/00946

§ 371 (c)(1),
(2), (4) Date: Nov. 26, 2002

(87) PCT Pub. No.: WO01/56450

PCT Pub. Date: Aug. 9, 2001

(65) Prior Publication Data

US 2003/0182817 A1 Oct. 2, 2003

(30) Foreign Application Priority Data

Jan. 31, 2000 (DE) ..... 200 01 932 U

(51) Int. Cl.
*F26B 25/00* (2006.01)

(52) U.S. Cl. ..... 34/104; 34/239

(58) Field of Classification Search ..... 34/104, 34/105, 106, 201, 202, 209, 210, 218, 222, 34/223, 224, 225, 230, 437; 285/189
See application file for complete search history.

(56) References Cited

U.S. PATENT DOCUMENTS

| | | | | |
|---|---|---|---|---|
| 3,052,490 | A * | 9/1962 | Greenlaw | 285/189 |
| 3,513,564 | A * | 5/1970 | Gramprie | 34/104 |
| 4,787,153 | A | 11/1988 | Chen | |
| 5,287,636 | A | 2/1994 | Lafleur et al. | |
| 5,289,642 | A | 3/1994 | Sloan | |
| 5,632,099 | A | 5/1997 | Seifert et al. | |
| 5,720,108 | A * | 2/1998 | Rice | 34/104 |
| 5,894,680 | A | 4/1999 | Dalvy et al. | |

* cited by examiner

*Primary Examiner*—Jiping Lu
(74) *Attorney, Agent, or Firm*—Michael Best & Friedrich LLP

(57) ABSTRACT

The invention relates to a device for drying shoes, gloves or garments comprising a fan which produces an airflow and which is accommodated in a housing. The housing comprises two openings that are connected to two tube sockets which are arranged opposite one another and which are fastened to said housing. The tube sockets are connected to tubes for guiding the airflow. To this end, the tube sockets are angular and one end of each tube socket is rotatably connected to the housing while forming a swivel joint.

17 Claims, 2 Drawing Sheets

DEVICE FOR DRYING SHOES, GLOVES OR GARMENTS

CROSS REFERENCE TO RELATED APPLICATIONS

This application is the U.S. National Phase of international patent application PCT/EP01/00946, filed on Jan. 30, 2001, and claiming priority to German utility model application number 200 01 932.5, filed Jan. 31, 2000, hereby incorporated by reference.

FIELD OF THE INVENTION

The invention concerns an apparatus for drying shoes, gloves or articles of clothing according to the introductory part of the main claim.

BACKGROUND OF THE THE INVENTION

Thus, in U.S. Pat. No. 5,720,108 is described a transportable drier for shoes and gloves. This drier consists of several component parts which can be connected to each other for use and housed separately during transport. With this drier, two flexible pipes or hoses can be connected to a housing in which is also contained a fan. In turn, air outlet nozzles can be attached to these flexible pipes or hoses. For adaptation to different required lengths, such as is the case for example for the drying of shoes with different heights of the uppers, there is the possibility of screwing the flexible pipes or hoses by means of formed threads to a greater or lesser depth into a corresponding receptacle of the housing and also arranging the air outlet nozzles in a corresponding manner to a greater or lesser depth by means of threads.

For reliable gripping of the drier, e.g. on or in shoes, a forked clamping element with which the two flexible pipes or hoses are pressed against each other is provided.

But by multi-part design of such a traditional drier it can happen that, particularly during periods in which the drier is not in use, for example in spring and summer, individual parts get lost and the drier without the lost parts has to be repurchased at great expense.

For adjustment of the desired length of the hoses or pipes, a great deal of time is necessary due to the elaborate screwing in and unscrewing of the different parts, since in the worst case four such screw joints must be operated.

Since air outlet nozzles of very simple design with which the air stream of preferably heated air is to be blown into the interior of shoes to be dried, are designed only as a simple angled portion at an angle of approximately 90°, there can be unwanted localised overheating on the excessively dry footwear. Moreover, certain regions inside shoes to be dried can be reached with injected air only inadequately, so that the required drying time is increased accordingly.

For reliably standing up the drier to dry gloves, it is proposed there that a further additional element be used, with which the housing with the fan can be held steady on a flat surface, which constitutes an additional part of this drier which likewise requires corresponding space and moreover can get lost.

It is therefore the object of the invention to provide a compact and cheap apparatus for drying shoes, gloves or textile articles of clothing, which is simple in construction, is easy to handle, allows effective drying and permits adaptation to different sizes of articles to be dried.

SUMMARY OF THE INVENTION

According to the invention, this object is achieved by the characteristics of claim 1. Advantageous embodiments and developments of the invention are apparent from the characteristics mentioned in the subsidiary claims.

According to the invention, on a housing comprising a fan are arranged two mutually opposed air outlet openings in each of which one end of an angled pipe socket engages in form-locking and/or force-locking relationship, forming a pivot joint. The pipe sockets are held reliably in the openings by the force-locking and/or form-locking connection, which can be designed as beading or flanging of the ends, but also by latch connections on the respective circumferences, and if necessary can also be released. Elastic pretensioning is provided by the formation of longitudinal slots in the circumference of the ends of the pipe sockets.

Due to the possibility of rotation of the pipes into the most varied angular positions, the apparatus according to the invention can be used flexibly, and the centre of gravity of the apparatus which is essentially predetermined by the housing with the fan and other components can be positioned in such a way that tipping over can be prevented, particularly when drying shoes. In particular in the case of small or light shoes, the centre of gravity of the apparatus can be adjusted in such a way that it does not lie in the region of the heel of shoes and a tilting moment as small as possible is maintained.

The apparatus according to the invention can be introduced with little force into the interior of shoes to be dried, in such a way that they are forced apart slightly and reliably seating and gripping of the apparatus on such shoes is guaranteed.

Due to the telescopic design of the pipes, adaptation to different heights of the uppers of shoes is possible, wherein with predetermined latch marks the telescopic pipes can be fixed at least in two end positions, namely the shortest and longest lengths of the pipes, or intermediate latch positions formed if occasion arises at regular intervals can be predetermined additionally by suitable shaping of the two pipe elements. The latch marks simultaneously prevent the pipe elements from falling apart.

Due to the ability of the air outlet nozzles to rotate about the longitudinal axis of the pipes, further adaptation to given drying situations is possible.

Due to the special shaping of the air outlet nozzles with inclined or curved opening or with nose-shaped or beak-shaped design, effective injection and hence conduction of the air flowing through the pipes into the shoes to be dried can be ensured. Also, leaning of the pipes or nozzle against the upper, particularly in the case of longer shoe uppers, does not lead to overheating, as the air can nevertheless emerge unhindered from the nozzle into the interior of the shoe. This applies equally if the length of the pipes has been not correctly or not optimally adjusted. Also such an arrangement has an advantageous effect for the drying of gloves without a separately specially designed attachment.

If the pipes with their telescopic construction are telescoped together the furthest possible and oriented parallel to the longitudinal axis of the housing wall, only a relatively small volume is taken up for mounting and transport, so that it is also easy to take it on journeys. In this case the angled air outlet nozzles can be rotated in such a way that the nozzle openings point towards each other, with the result that the space between the pipes, which is predetermined by the housing dimensions, can be used.

BRIEF DESCRIPTION OF THE DRAWINGS

A practical example of the invention is shown in the drawings and described in more detail in the description below. They show.

DETAILED DESCRIPTION OF THE INVENTION

Figure 1:
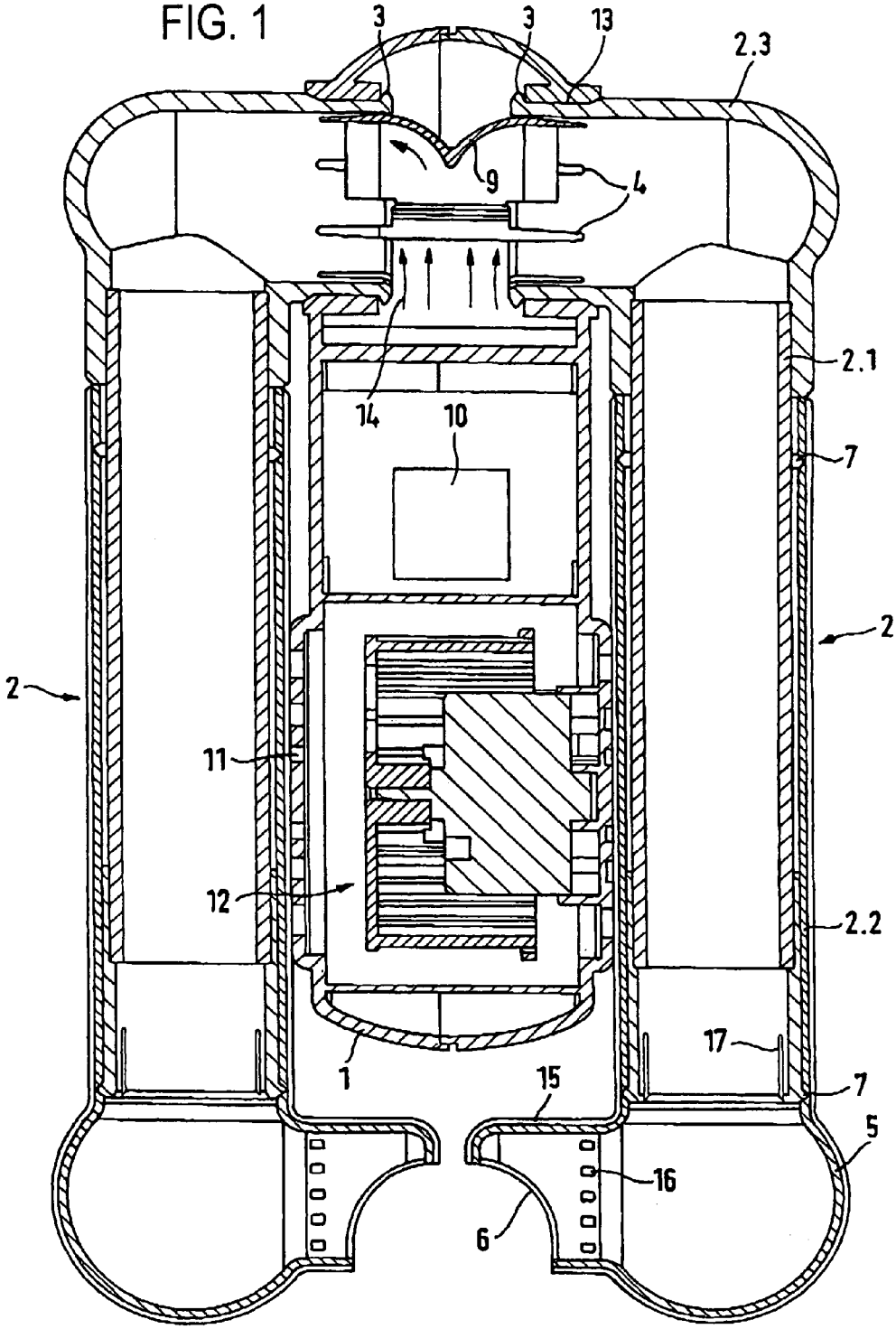
FIG. 1 a sectional view through a practical example of the apparatus according to the invention and FIG. 2 a side view of an example of an apparatus according to the invention.
Figure 2:
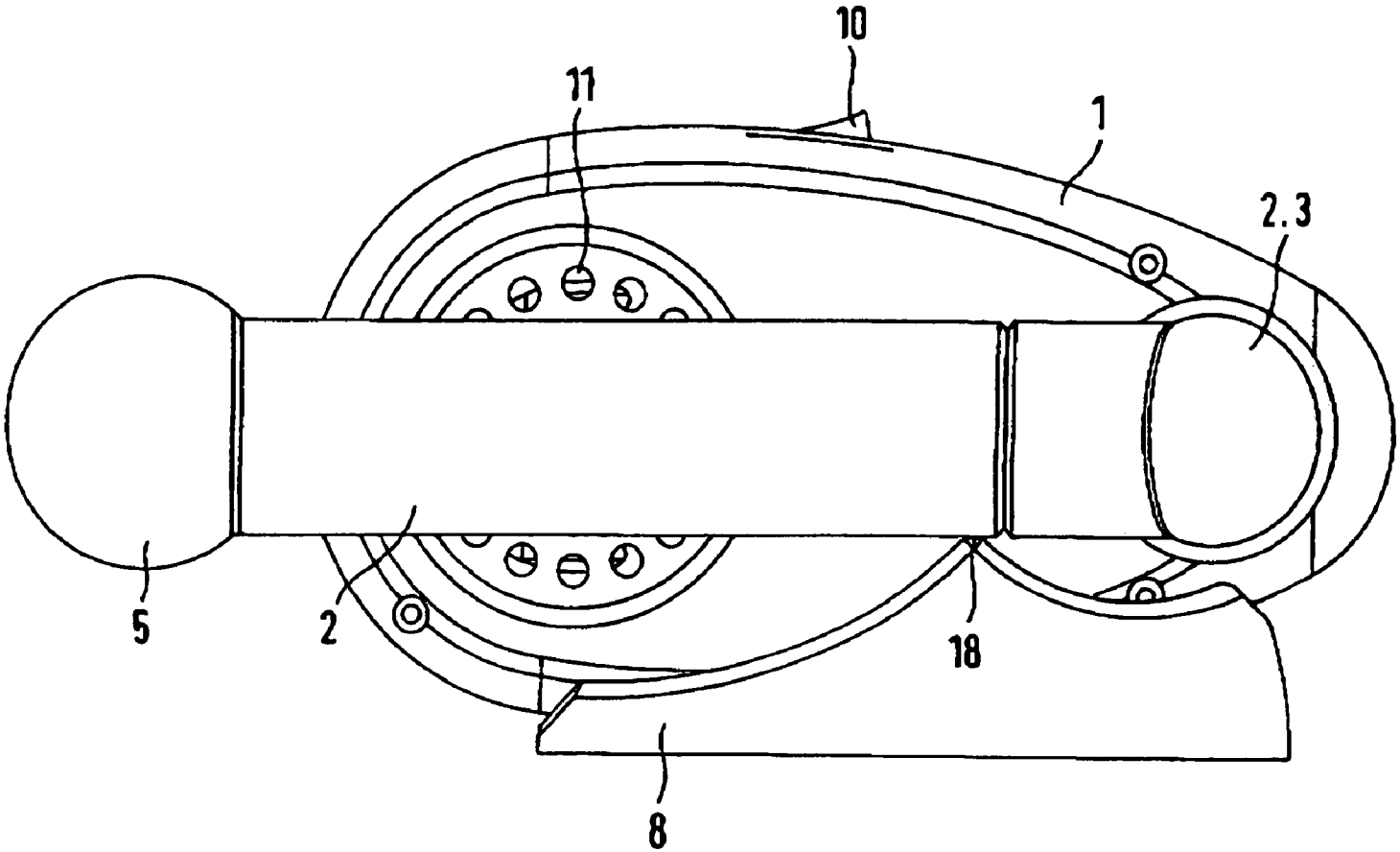

The apparatus shown in FIG. 1 and FIG. 2 for drying shoes, gloves or articles of clothing comprises a housing 1 and two pipes 2 which are attached to the housing and which are arranged directly adjacent to the housing 1 like arms. In the housing 1 are contained an electrically operated fan 12 as well as electrical components for driving the fan 12, wherein the electrical supply can be delivered via a cable, not shown, from mains and/or a battery and/or a chargeable accumulator. To switch the fan on and off, a switch 10 is embedded in a narrow side wall of the housing 1. In the region of the fan 12 the housing is provided with intake openings 11 through which air is drawn in from the outside by the fan. The fan 12 includes a fan housing which is adjoined by an air duct (not shown), wherein in the air duct is arranged a heating device, e.g. a radiator (not shown), which heats the air delivered by the fan 12.

In the upper region of the housing 1 (seen in the view as in FIG. 1) are formed two mutually opposed openings 13 of round cross-section in each of which engages a pipe socket 2.3 which forms part of the pipe 2 and which is bent at an angle of approximately 90°. The respective pipe socket 2.3 is fixed by a flange 3 at its edge in the opening 13, wherein the flange 3 engages behind the edge of the opening 13 directed into the interior of the housing 1 and forms with the edge a form-locking means. Here, the flange 3 can be formed over the whole circumference of the end of each pipe socket 2.3 or only in a certain region. Moreover, the ends of the pipe sockets 2.3 held in the respective opening 13 are provided with longitudinal slots 4 which open towards the end and which cause the pipe sockets 2.3 to be capable of being inserted with preliminary tension in the openings 13, so that locking of the pipe sockets 2.3 in the openings 13 is assisted by force locking. Moreover, introduction of the pipe sockets 2.3 into the openings 13 is made easier.

The end of the pipe sockets 2.3 engaging in the respective opening 13 thus forms a pivot joint with the circumferential wall of the opening 13, with the result that the respective pipe socket 2.3 can be rotated 1 to 360° relative to the housing 1.

Opposite the outlet of the air duct connected to the fan housing is arranged an air stream divider 9 which comprises two surfaces curved concavely, each starting from the centre, such that the air stream emerging from the air duct according to the arrows 14 is at least partially deflected at the surfaces of the air stream divider 9 and divided into two partial streams. The air stream divider 9 is positioned and clamped by the housing 1, which comprises two halves, between the latter.

The pipe sockets 2.3 form part of the pipes 2 which are essentially arranged adjacent to the housing 1, wherein the pipes are designed as telescopic pipes which are variable in length. For this purpose in each case two pipe elements 2.1 and 2.2 are provided which are displaceable relative to each other. In the practical example, the inner pipe element 2.1 is rigidly connected to the pipe socket 2.3, wherein the joint can be designed as a welded or adhesive joint, but pipe socket 2.3 and pipe element 2.1 can also be made as an injection moulding. The inner pipe element 2.1 can be designed as a rigid pipe, but it can also be flexible, for example a hose.

The outer pipe element 2.2 encompasses the inner pipe element 2.1, wherein the cross-sectional shapes of the pipe elements essentially correspond to each other. The cross-sectional shapes of the pipe elements 2.1 and 2.2 are not fixed, but preferably a round cross-section of the pipe elements is to be selected.

At the outer circumference of the inner pipe element 2.1 and at the inner circumference of the outer pipe element 2.2 are mounted latch elements 7 which can be designed as a peripheral annular projection and as an annular groove, and form the latch connections for fixing the end positions of the pipe elements 2.1 and 2.2 relative to each other. The latch elements are here located in each case roughly in the region of the ends of the pipe elements. Naturally, several latch elements 7 can also be mounted over the length of the pipe elements.

To make it easier to fit the outer pipe element 2.2 over the inner pipe element 2.1 or to make it easier to displace the pipe elements relative to each other, the free end of the inner pipe element 2.1 is provided with longitudinal slots 17 which deliver a certain elasticity and preliminary tension. In the present case the longitudinal slots 17 are formed in a pipe section, i.e. the inner pipe element 2.1 is in two parts, the two parts being rigidly connected to each other.

On each of the pipes 2 at the end opposite the pipe socket is arranged a pipe attachment or nozzle head 5 which in the present embodiment forms part of the outer pipe element 2.2, but which can also be connected thereto as a separate part. The nozzle head 5 is rotatable about the longitudinal axis of the pipe, i.e. in the present embodiment the outer pipe element 2.2 is rotatable about the inner pipe element. On the nozzle head 5 is integrally formed the actual air nozzle 15, which comprises a nozzle opening or air outlet opening 6. The air nozzle 15 is angled approximately at an angle of 90° to the longitudinal axis of the pipe 2 and has a curved shape in axial section, i.e. it is nose-shaped or beak-shaped. Also the air outlet opening 6 is curved, i.e. it is arcuate in axial longitudinal section, wherein the circumferential wall of the pipe attachment 5 exhibits the nose-shaped, radially inwardly directed curvature over a partial region. Such an embodiment delivers favourable conduction of the air flow through the large curved air outlet opening 6. In this way the air stream has a flow component formed obliquely to the axial direction of the pipe attachment.

In the embodiment shown, the nozzle head 5 is hollow and spherical, wherein the air nozzle 15 is formed integrally with the sphere as an attachment, but it is also possible for the outer pipe element to be angled preferably at an angle of approximately 90°, wherein the air outlet opening 6 can likewise be provided arcuately or obliquely over the whole angled portion or over a region according to the design as in FIG. 1.

In addition to the air outlet opening 6, at the circumference of the air nozzle 15 can be provided further smaller air outlet openings 16 which are arranged at a distance from each other in the circumferential wall.

The manner of operation of the apparatus will be described in more detail by the example of drying shoes. Here, the shoes or boots are stood adjacent to each other and the telescopic pipes are each inserted in a shoe, wherein beforehand the length of the pipes, i.e. the length of displacement of the outer pipe element 2.2 on the inner pipe element 2.1, has been adapted to the length of the upper. The pipes are rotated or pivoted by means of their pivot joint in relation to the housing in such a way that the housing rests on the edges of the shoes, wherein due to the pivotability of the pipes in relation to the housing the centre of gravity is selected so that a stable arrangement is provided. The air nozzle or the nozzle head is rotated relative to the longitudinal axis of the pipe in such a way that the air flow is conducted in the desired direction. Preferably, the pipes comprise not only two latch connections for the end positions, i.e. for the minimum and maximum lengths, but in addition intermediate latch positions, so that the desired lengths of the pipes are fixed stably. The air stream generated by the fan 12 is evenly distributed between the two pipes 2, wherein the air stream divider 9 assists this even distribution.

FIG. 2 shows a side view of the apparatus according to FIG. 1, wherein in both figures the apparatus is shown in the transport position in which the pipes are retracted to their minimum length and the air nozzles 15 are rotated in relation to the longitudinal axis of the pipes 2 in such a way that they are opposite each other and point inwards. Hence little space is necessary.

In addition to the design as in FIG. 1, in FIG. 2 is provided a stand element 8 which is connected to the housing 1 and which comprises a flat main surface on which the housing can be stood. Such standing is particularly favourable for drying gloves or articles of clothing, wherein the pipes 2 can be pivoted in the desired manner and the air nozzle 15 or nozzle head 5 can likewise be rotated in the desired direction.

The stand element 8 can be an integral part of the housing 1 or releasably connected to the housing 1. On the stand element 8 in the present embodiment is formed a stop 18 which limits the rotational movement of the pipes 2. Naturally, stops can also be formed integrally on the housing 1.

The invention claimed is:

1. Apparatus for drying shoes, gloves or articles of clothing with an air stream-generating fan which is contained in a housing, wherein the housing comprises at least one air outlet opening which is connected to two oppositely mounted pipe sockets attached to the housing and wherein the pipe sockets are connected to pipes for further conduction of the air stream, and wherein further the pipe sockets are angled and one end of each pipe socket is rotatably connected to the housing, forming a pivot joint, wherein the end of each pipe socket engages in an opening, wherein a circumferential wall of the opening and the end of the pipe socket form with each other a form-locking connection.

2. Apparatus for drying shoes, gloves or articles of clothing with an air stream-generating fan which is contained in a housing, wherein the housing comprises at least one air outlet opening which is connected to two oppositely mounted pipe sockets attached to the housing and wherein the pipe sockets are connected to pipes for further conduction of the air stream, and wherein further the pipe sockets are angled and one end of each pipe socket is rotatably connected to the housing, forming a pivot joint, wherein a flange portion proximate the end of each pipe socket engages in an opening, wherein a circumferential wall of the opening and the flange portion proximate the end of the pipe socket form with each other a form-locking connection.

3. Apparatus according to claim 2, wherein the pipes connected to the pipe sockets each comprise at least two pipe elements fitted one inside the other, which are telescopically extendable.

4. Apparatus according to claim 2, wherein the end of each angled pipe socket which is held in the opening comprises outwardly opening slots.

5. Apparatus according to claim 2, wherein in the housing between the pipe sockets is arranged an air stream divider.

6. Apparatus according to claim 2, wherein on the mutually facing inner and outer surfaces of the pipe elements are formed latch elements for at least one form-locking engagement in at least one predetermined latch position.

7. Apparatus according to claim 2, wherein at the end of each pipe facing away from the pipe sockets is arranged as an air outlet nozzle with at least one nozzle opening which is designed as a pipe attachment angled perpendicularly to the longitudinal axis of the pipe, wherein the nozzle opening is arranged at the end of the pipe attachment.

8. Apparatus according to claim 7, wherein the air outlet nozzles are rotatable about the longitudinal axis of the pipes.

9. Apparatus according to claim 7, wherein the contour of the nozzle opening seen in the axial section of the pipe attachment is oblique.

10. Apparatus according to claim 7, wherein a circumferential wall of the pipe attachment forming the air outlet nozzle is partially drawn radially inwards in the region of the nozzle opening, such that the air outlet nozzle in the axial section of the pipe attachment is nose-shaped or beak-shaped.

11. Apparatus according to claim 7, wherein in a circumferential wall of the respective air outlet nozzle includes a plurality of nozzle openings.

12. Apparatus according to claim 7, wherein a stand element is formed on the housing.

13. Apparatus according to claim 7, wherein the contour of the nozzle opening seen in the axial section of the pipe attachment is curved.

14. Apparatus according to claim 7, wherein a stand element is releasably attached to the housing.

15. Apparatus according to claim 2, wherein at the end of each pipe facing away from the pipe sockets is arranged an air outlet nozzle with at least one nozzle opening which is designed as a pipe attachment angled obliquely to the longitudinal axis of the pipe, wherein the nozzle opening is arranged at the end of the pipe attachment.

16. Apparatus according to claim 2, wherein the flange portion extends continuously about the circumference of the end of the pipe socket.

17. Apparatus according to claim 2, wherein the flange portion extends intermittently about the circumference of the end of the pipe socket.

* * * * *